United States Patent [19]

Magley

[11] Patent Number: 4,785,963

[45] Date of Patent: Nov. 22, 1988

[54] TAMPER-EVIDENT BUTTRESS PLUG CLOSURE

[75] Inventor: Robert E. Magley, Auburn, Ind.

[73] Assignee: Rieke Corporation, Auburn, Ind.

[21] Appl. No.: 142,510

[22] Filed: Jan. 11, 1988

[51] Int. Cl.[4] ..... B65D 41/34

[52] U.S. Cl. ..... 220/266; 220/284; 215/252

[58] Field of Search ..... 215/252; 220/266, 265, 220/276

[56] References Cited

U.S. PATENT DOCUMENTS

| | | | |
|---|---|---|---|
| Re. 31,496 | 1/1984 | Keeler | 215/252 |
| 1,891,033 | 12/1932 | Wackman | 220/284 |
| 1,901,196 | 3/1933 | Shera | 220/284 |
| 2,054,031 | 9/1936 | Conner | 215/252 |
| 2,134,178 | 10/1938 | Esposito | 215/252 |
| 2,423,582 | 7/1947 | Coleman | 215/252 |
| 2,940,627 | 6/1960 | Schultz | 215/250 |
| 3,074,580 | 1/1963 | Golde | 215/250 |
| 3,811,590 | 5/1974 | Hall, Jr. | 215/207 |
| 4,019,663 | 4/1977 | Krautkramer | 222/541 X |
| 4,062,466 | 12/1977 | Conti | 215/252 |
| 4,081,097 | 3/1978 | Dold | 215/252 |
| 4,153,174 | 5/1979 | Keeler | 215/252 |
| 4,165,813 | 8/1979 | Babiol | 215/252 X |
| 4,308,969 | 1/1982 | Heisler et al. | 220/266 |
| 4,326,639 | 4/1982 | Stahl | 215/252 |
| 4,458,820 | 7/1984 | Abrams | 215/250 |
| 4,666,063 | 5/1987 | Holoubek | 215/250 X |
| 4,687,112 | 8/1987 | Swartzbaugh | 215/216 |

*Primary Examiner*—Donald F. Norton

*Attorney, Agent, or Firm*—Woodard, Emhardt, Naughton Moriarty & McNett

[57] ABSTRACT

A tamper-evident buttress plug for sealing closed a plastic 55-gallon drum includes a plug body which is externally threaded and compatible with the internally threaded container outlet, a ratchet ring which includes a circumferentially distributed series of ratchet teeth on its inner surface and a series of four frangible elements which initially integrally join the ratchet ring to the plug body. The container outlet has neck which is configured with two spaced series of ratchet teeth which are of a size and configuration so as to be mutually engageable with the ratchet teeth on the closure ring. As the closure is threadedly advanced into the outlet, threaded engagement is first achieved and then ratchet engagement. When it is time for the closure to be removed from the container, the frangible elements must be severed so as to separate the ring and the plug body. In view of the fact that the 55-gallon plastic drum is blow-molded by split-block technique, it is necessary for the two series of ratchet teeth on the container outlet to be less than 180° in their circumferential extent thus leaving spaces between the series. In order to prevent compression of the ring by squeezing inwardly at the location of these two spaces, semi-circular raised protuberances are provided in order to prevent ovalizing and an ability to disengage the ratchet teeth.

19 Claims, 2 Drawing Sheets

TAMPER-EVIDENT BUTTRESS PLUG CLOSURE

BACKGROUND OF THE INVENTION

The present invention relates in general to tamper-evident closures for containers and in particular to tamper-evident buttress plugs for 55-gallon drums and related containers.

During the storage and transport of shipping receptacles containing materials such as liquid foodstuffs and chemicals, there is a risk that an unauthorized individual may gain access to the contents. In order to alert the recipient or end user to any possible tampering attempts, packagers and shippers have used tamper-evident closures. This type of closure typically includes frangible elements or tearable membranes or a pry-off cover or overseal which once defeated provides a visible indication of such tampering which cannot be replaced or mended back into its original form. The recipient or end user upon seeing the broken frangible elements or the cover removed is warned that unauthorized access to the contents may have occurred. The effect is to preclude the use of such foodstuffs or chemicals without careful checking to see if the contents are pure. Any container which is received with the tamper-evident feature intact gives an indication that tampering has not occurred and those containers do not have to be additionally inspected. Since these containers may include food or chemical ingredients which are only one part of a larger combination or mixture, it is imperative that the contents not be used if they are contaminated for both cost and safety reasons.

The options for tamper-evident closures are somewhat governed by the style of the container and its neck or pouring outlet. If the outlet is internally threaded, one style of closure will be selected while a different style will be required for externally theaded container outlets. Within each of these two basic styles, there are a number of variations as to the configuration and location of frangible elements, the use or absence of ratchet teeth and how these are applied to the closure and outlet.

Several of these varying styles are disclosed by one or more of the following prior references, some of which are believed to be representative of closures having tamper-evident styling.

| Patent No. | Patentee |
|---|---|
| 4,687,112 | Swartzbaugh |
| 4,666 063 | Holoubek et al. |
| 4,458,820 | Abrams |
| Re. 31,496 | Keeler |
| 4,153,174 | Keeler |
| 4,326,639 | Stahl et al. |
| 4,165,813 | Babiol |
| 4,081,097 | Dold |
| 4,062,466 | Conti |
| 4,019,663 | Krautkramer |
| 3,811,590 | Hall, Jr. |
| 3,074,580 | Golde |
| 2,940,627 | Schultz |
| 2,423,582 | Coleman |
| 2,134,178 | Esposito |
| 2,054,031 | Conner et al. |
| 1,901,196 | Shera |
| 1,891,033 | Wackman |

Swartzbaugh discloses a child-resistant package that includes a wide mouth blown glass container or blow-molded plastic container and a molded thermoplastic closure that is affixed to the finish portion of such container. The finish portion of the container has a radially outwardly projecting flange at the bottom portion of such finish portion and this flange has a notch in its outer periphery. The closure has a flexible projection that extends outwardly and downwardly from the skirt of the closure and a portion of this projection engages the notch in the flange of the finish to prevent the turning of the closure on the finish. This particular reference is typical of those closure designs which are intended more as a child-resistant scheme than a tamper-evident configuration. This particular closure may be reused and does not disclose any type of frangible elements or membranes which must be torn or broken in order to open the container.

Holoubek discloses a container with a twist-off tamper-evident feature which is disposed as an integral seal member formed across the outlet in the neck of a thermoplastic container. This seal member must actually be broken free from the neck in order to gain access to the contents. Torque is applied to the seal member by providing in the top of a conventional screw cap which forms a resealing closure for the container a recess with serration which, when the cap is removed and turned upside down, engage serrations on the peripheral edge of the integral seal member. This particular reference is of interest with regard to the present invention in that actual breaking or severing must be achieved in order to gain access to the contents of the container. However, this disclosure is different from the present invention in that the container itself is sealed and the severing of the seal is directly from the container rather than severing a portion of the closure from the remainder so that the remainder can be removed without altering or otherwise modifying the container style.

Abrams discloses a tamper-indicating arrangement for a container which functions to provide a visual indication that the container has been opened. This particular arrangement includes a closure which is adapted to be fitted to the container and includes first and second coacting means for respectively retaining the closure on the container in distinct first and second positions with respect to the container. In this way, the closure can be initially applied to the container in its first position and can only be reapplied and retained on the container in a reoriented second position. This particular disclosure is dissimilar from the present invention in that frangible elements are not provied which must be broken in order to remove the closure from the container.

Keeler (U.S. Pat. No. Re. 31,496) is a reissue of Keeler (U.S. Pat. No. 4,153,174) and these will be reviewed together in view of the common subject matter. Keeler discloses a tamper-proof closure for a container having a member projecting from its neck in which the closure is thermoformed with a skirt wall having a tab which engages the projecting member and which breaks off as the closure is unfastened from the container. This particular style of closure and container includes a container neck which is externally threaded and a closure which is internally threaded with the closure having a single tab 76 which engages segments 71 around the neck of the bottle with spaces therebetween. While this may be regarded as a ratcheting configuration, this particular type of closure is not styled nor arrranged nor structurally suitable for the necessary Department of Transportation (DOT) requirements for over-the-road transported 55-gallon drums as set forth in CFR 49, part 178.19, Spec. 34, is not molded in a fashion which creates special concerns as to the series of ratchet teeth around the neck and does not include frangible elements of the type disclosed in the present invention.

Stahl discloses a screw cap for bottle type containers and has the same deficiencies as previously noted for Keeler. Stahl is of some interest with regard to the present invention in that it includes a collar 20 which is joined to the cap by a plurality of shearable links 27, 29 in a circumferentially distributed arrangement to the outer circumferential surface of the top edge 12. Although these links are sheared off as part of the removal process, this particular reference does not disclose the configuration and interlocking ratchet teeth nor the style of frangible elements as presented by the present invention.

Babiol discloses a security closure device for bottles which includes a capsule screwed on the neck, a cap surrounding the capsule and a tearable guarantee strip. Although ratchet tooth engagement is disclosed, this occurs between an inner seal and outer cap and does not involve the neck of the container. This particular disclosure is also geared to a bottle cap configuration and is not styled nor suitable for use with the buttress plug requirements for transported 55-gallon drums which is the focus of the present invention.

Dold discloses a similar bottle cap style described as a safety closure for bottles with a thread on the neck and a bead arranged thereunder. This particular invention includes a screw cap and a safety ring fastened thereon with safety fracture stays. At least two teeth are arranged offset relative to one another by a circumferential angle on the neck of the bottle on the bead. At least to break-open pins which are offset relative to one another by a circumferential angle are joined on the lower edge of the screw cap.

Conti discloses a tamper-proof closure cap with a self-removing ring typical of the type currently seen on plastic milk bottles. The container closure cap is provided with a ring that breaks away from the cap in a strip as the cap is twisted open. Although this type of frangible ring and ratchet tooth engagement may have some similarity to aspects of the present invention, it is once again noted that the present invention focuses on buttress plug closures for transported 55-gallon drums and by that design must take into account and consideration the manufacturing style and configuration of the closure and the various DOT requirements for containers of this type. Conti, as typical of many of the references listed, simply is not styled for this type of closure and container combination. Consequently, many of the requirements are ignored and the overall design as presented by Conti is simply not suitable for the closure and container combination which is the focus of the present invention.

Krautkramer discloses separating means for plastic closure tops involving a plastic closure for a container which is molded in an integral single piece. This particular disclosuree includes a closure ring at the bottom which seats in the opening in the container a spout at the top of the closure, and above the spout is a dual-purpose closure element which seals the closure before its first use and after the closure element is initially torn loose, the closure element is thereafter placed in and removed from the spout to seal the spout. Integrally molded between the base of the closure element and the top of the spout is tear-off band having a removable handle such that drawing upon the handle removes the band and separates the closure element from the spout.

Hall, Jr. discloses a safety container closure for small plastic medicine bottles. A plug is inserted into the top or neck in a tight friction fit. The plug carries a key recess and the outer cap fits over the top of the container and carries a key molded to it. The key is placed into the recess in the plug engaged for withdrawal. An upper rib on the plug fits into a groove in the container to inhibit dislodgement. This particular disclosure once again is of conventional bottle and cap configuration and is not compatible with the transported 55-gallon drum container style of the present invention.

Golde discloses a closure for bottles wherein a portion of the closure is inserted down into the bottle mouth or outlet opening and the remainder of the closure extends over and around that opening. The closure is of an integral molded one-piece construction of a soft resilient plastic thereby making possible the insertion of this inward projecting sealing portion.

This particular disclosure does not include any type of frangible elements nor any type of closure container of the transported 55-gallon style and thus is believed to have limited relevancy to the present invention.

Also having limited relevancy is the patent to Schultz which is a champagne bottle closure and is provided herewith solely for its showing of a plug which fits into the interior of the neck opening and for its disclosure of an outer ring which must be defeated and removed from the closure plug in order to remove that plug from the container.

Coleman discloses a bottle cap and once again while its application to the present invention is quite limited, it does include a series of ratchet type teeth engagement where one set of ratchet teeth are disposed on the outer surface of the container neck. In contrast to the present invention, the engaging ratchet teeth are on the cap and not part of a separable frangible ring.

Esposito discloses a bottle cap which includes a series of ratchet teeth around the neck or outlet opening of the bottle and a removable engaging ring which is torn free in order for the bottle cap to be removed from the bottle. This particular invention includes a sheet metal screw cap and a bottle design which is not similar to the 55-gallon drums of the present invention.

Connor discloses a container closure of the conventional bottle and cap style wherein there is provided a breakable indicator member which may be formed to constitute a closure for the container. The readily breakable indicating member whether separate from the primary closure or otherwise is performed and adapted to be put in place on the container without substantial change in size or shape and is to be distinguished from various devices of the prior art consisting of sheet metal or paper or fabric or other material adapted to be crimped or folded or shrunk or otherwise put into place by change in size or shape.

Shera discloses a closure device for the filling and/or discharge openings of metallic containers such as drums, barrels and the like and is specifically directed to closure plugs for these types of containers. This particular patent discloses a style of prior art tamper-evident feature namely in the form of seal cap 18 which is applied over the outer bead or edge of the container outlet and completely covers the removable portion of the closure plug thereby precluding removal of the plug until this seal is defeated. This cap 18 is formed of relatively thin metal and once it is secured over the bead, it cannot be removed without protection and in fact without destroying its further usefulness. This patent also discloses an internal recess to the plug and wedge-shaped, diameterically opposed lugs which extend integrally from and radially inward of the inner wall of the plug and terminate short of the central portion thereof and are intended to be compatible with a wrench or similar tool for rotating the plug for advancement and removal.

Wackman discloses a sealing cap for the plugs of metal drums and the like wherein an overseal is applied and is constructed of lightweight resilient metal and this device also includes a hex recess for use with a wrench for advancing and removing the closure plug.

While the foregoing group of references may all fit within the general category of container or bottle closures and in many cases in the category of tamper-evident closures, they are not in any case suitable for meeting the DOT performance requirements (see CFR 49, part 178.19, spec. 34). There are specific drop test and hydrostatic requirements for closures used on large containers (55-gallon drums, etc.) which must be met if the container is transported over the road. None of the foregoing references are styled or designed to meet those requirements, and any containers which are suitably designed for those requirements do not have any tamper-evident features simillar to the present invention.

In order to provide a tamper-evident closure which is suitable for plastic 55-gallon drums and which meets all DOT and drop test requirements, a new design is required over what is presented by the foregoing group of references or otherwise available. This unique closure is provided by the present invention which also incorporates novel features in the design of the neck of the container outlet for a unique cooperating combination.

SUMMARY OF THE INVENTION

A tamper-evident buttress plug closure for use in closing the internally threaded and externally ratcheted outlet of a container according to one embodiment of the present invention comprises an externally threaded plug body threadedly engageable with the interior of the outlet and including means for advancing and withdrawing the plug body relative to the outlet, a frangible interlocking ring including a plurality of internal ratchet teeth engageable with the externally ratcheted outlet, and a connecting frangible element initially and integrally joining the interlocking ring to the plug body with the plug body received by the outlet and severable upon retrograde movement of the plug relative to the outlet.

One object of the present invention is to provide an improved tamper-evident buttress plug closure.

Related objects and advantages of the present invention will be apparent from the following description.

BRIEF DESCRIPTION OF THE DRAWIGS

DESCRIPTION OF THE PREFERRED EMBODIMENT

Figure 1:
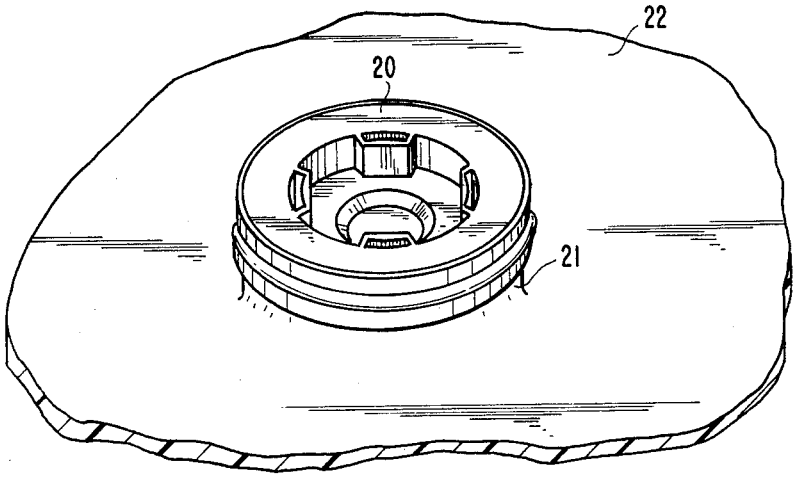
FIG. 1 is a perspective view of a buttress plug closure as applied to a plastic 55-gallon drum container according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
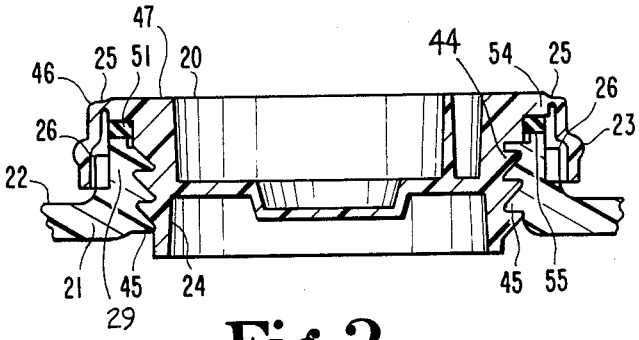
FIG. 2 is a front elevation view in full section of the FIG. 1 closure and outlet.

Referring to FIGS. 1 and 2, there is illustrated a tamper-evident buttress plug closure 20 which is received by the internally threaded outlet 21 of a plastic 55-gallon shipping container 22. Container 22 is typical of the type used to ship food processing fluids such as syrup or concentrate for beverages. The 55-gallon amount in turn creates a much larger volume of finished product. If the syrup or concentrate is contaminated as a result of unauthorized access and goes unnoticed until after the final processing step in preparation of the end mixture, the loss is substantial and goes well beyond merely the loss of the initial 55-gallon amount.

Figure 6:
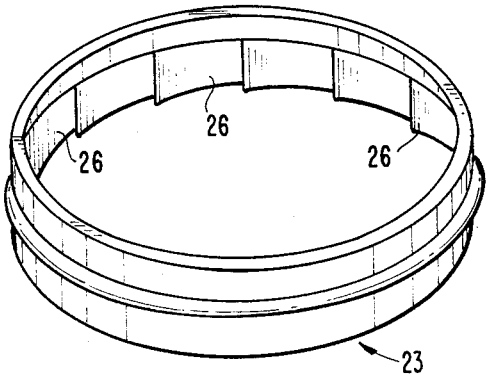
FIG. 6 is a perspective view of the ratchet ring portion of said FIG. 1 closure.

The tamper-evident nature of the present invention is achieved by providing closure 20 with a frangible ratchet ring 23 which is integrally joined with and substantially concentric to the plug body 24 by means of a series of four evenly spaced and similarly styled frangible elements 25. The interior surface of ring 23 is disposed with a continuous series of ratchet teeth 26 (see FIG. 6) which have an axial height which is approximately one-half the ring.

Figure 3:
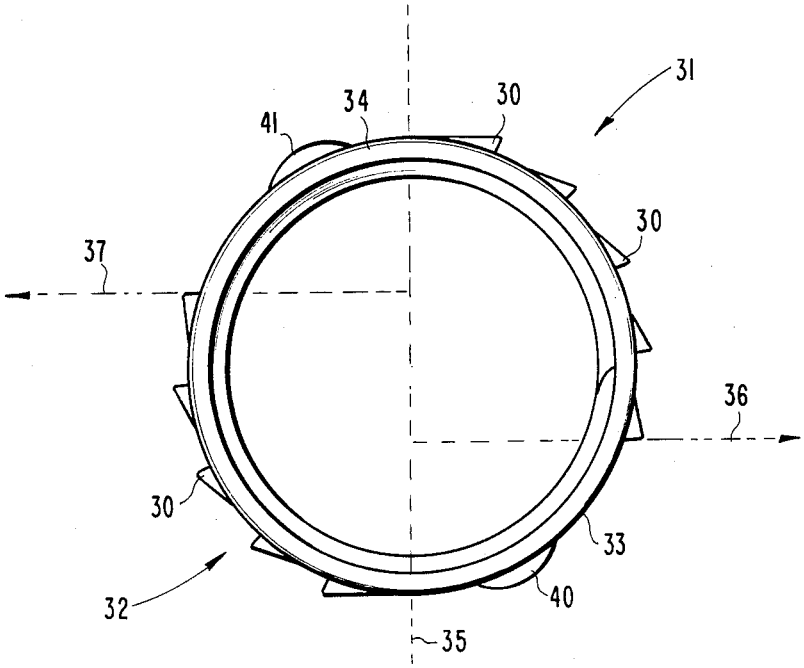
FIG. 3 is a top plan view of the FIG. 1 container outlet.

In order to complete th tamper-evident nature of the present invention, the outer surface of the neck 29 of the container outlet 21 is provided with a plurality of ratchet teeth designed and arranged to be compatible to and engageable with the ratchet teeth 26 of ring 23 (see FIG. 3). The teeth 30 of the container outlet are arranged into two spaced series 31 and 32 which are uniformly disposed on opposite sides of the outlet and separated from one another by two areas 33 and 34 on the outer surface which are free of any ratchets. These two ratchet-free areas are particularly significant due to the method of producing container 22 and the problems associated with ratchet teeth and similar features with this method of production.

Container 22 is manufactured out of plastic and produced by a blow-molding technique using split blocks. In this production method, the split blocks are separated from the completed part by movement in a direction substantially normal to the abutting faces of the split blocks which coincide with the mold parting line, shown in FIG. 3 as line 35. If the series of ratchet teeth extended completely around neck 29, the curvature of taper to the abutment face of the teeth would prevent the removal of the split blocks. Consequently, the two series of ratchet teeth extend only from the parting line 35 to a line which is substantially normal to line 33 and which is parallel or slightly less than parallel to the abutment face of the last ratchet tooth in each series. These normal lines are shown as lines 36 and 37. In this manner, the preferred blow-molding technique can be used and the two series of ratchet teeth can be molded integrally with the neck of the outlet but in a manner such that they do not interfere with removal of the split blocks.

The two ratchet-free areas 33 and 34 do not present any problems of drawback except for one concern. If a tampering attempt was made, the individual might try to compress inwardly (squeeze together) the ratchet ring at locations corresponding to the two ratchet-free areas. Without some blockage or impediment at that location, the ratchet ring could be distorted into an elliptical shape (ovalizing) which might enable the ratchet teeth of the ring to be drawn out of interlocking engagement with the two series of ratchet teeth on the neck of the container outlet and thereby defeat the closure. In order to prevent this type of tampering attempt from being successful, the neck of the container outlet includes two semi-circular raised protuberances 40 and 41 which are centered in areas 33 and 34, respectively, and extend radially a sufficient distance in order to prevent virtually any distortion of ring 23 in the manner describd (ovalizing). In the preferred embodiment protuberances 40 and 41 extend radially to a location just inside the radially outermost edge of ratchet 30 so that there is no interference between teeth 26 of ring 23 and protuberances 40 and 41 during advancement of the closure into the outlet and subsequent removal.

Figure 4:
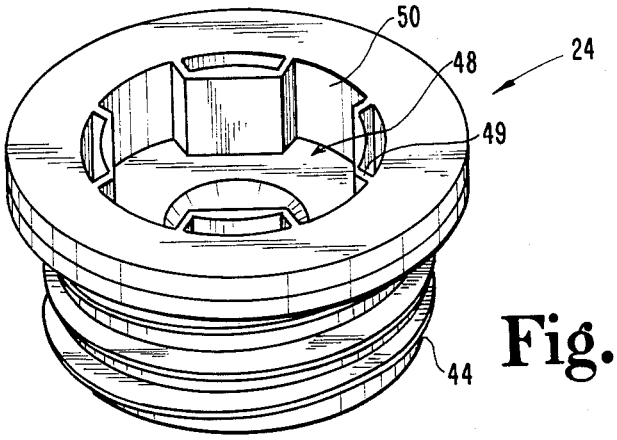
FIG. 4 is a perspective view of the plug body portion of the FIG. 1 closure.
Figure 5:
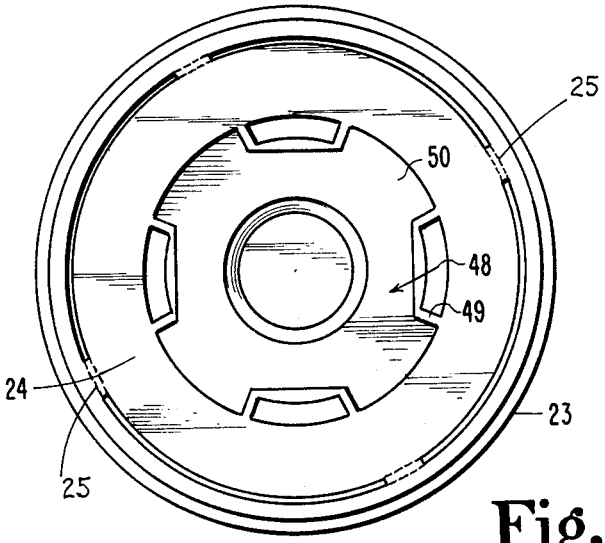
FIG. 5 is a top plan view of the FIG. 1 closure and outlet combination.

In use, container 22 is filled and closure 20 applied. As illustrated in FIG. 4, the body portion 24 of closure 20 includes a series of external threads 44 which are of a size and pitch to be received by the internal threads 45 of outlet 21. These two sets of threads first achieve engagement and thereafter as the closure is advanced into the outlet, the ratchet teeth are brought into contact. As should be readily understood, the contours of the ratchet teeth and their respective orientations and spacing enable interlocking engagement as the closure is threadedly advanced into the outlet. Once the closure is fully seated, any retrograde movement of the closure is resisted by multiple points of abutment between the ratchet teeth of the ring and the two series of ratchet teeth on the outer surface of the neck of the container outlet.

In order to defeat this interlocking abutment, ring 23 must be separated from the plug body 24. This separation is designed to be achieved by severing or fracturing the four frangiblle elements 25 which integrally join the ring and plug body together as closure 20. Once these frangible elements are broken, the plug body is removable from the outlet in order to gain access to the contents of the container. The ring remains on the neck but can be removed after the plug body is unscrewed.

A further aspect of the tamper-evident and tamper-preventive nature of the invention is the positional relationship between the ring and plug body. As is illustrated the top or upper edge surface 46 of the ring 23 is initially substantially flush with the top or upper surface 47 of the plug body 24. Consequently, it is not possible to unscrew the plug by grasping the outer diameter surface, simply because this surface is not accessible. In order to enable secure tightening of the closure and subsequently unscrewing of the plug body, the top surface 47 of the plug body includes a deeply recessed portion 48 arranged with a fluted axial wall configured with four substantially evenly spaced inwardly protruding trapezoidal-like ribs 49 which are alternately arranged and spaced by four channels 50. This contour is compatible with a wrench-like tool which may be placed into recessed portion 48 and fits within the ribs and channels for insertion tightening of the closure and removal of the plug body.

A secure engagement and snug fit between the wrench-like tool and plug recess is important so that adequate torque can be applied without the tool slipping out or the ribs and channels being fractured or stripped. This torquing ability assures tight sealing or initial application as well as on subsequent plug replacements and this enables the four frangible elements to be fractured automatically as the plug is unscrewed after initial installation.

As a further feature to assist in enabling a fluid-tight and secure seal between the closure and container outlet, a synthetic material gasket 51 is provided and disposed directly beneath the outer lip 54 of the plug body 24 and directly above the top edge 55 of outlet 21 such that gasket 51 is slightly compressed as the closure or plug body achieves full threaded engagement with the container outlet.

With ring 23 removed, the remaining plug body is typical of the plug design which is standardized for the industry and the 55-gallon container is also somewhat standardized for the industry except for its outer surface of the neck which includes the two series of ratchets and the two protuberances. The threads 44 on the plug body are standard American buttress threads for 55-gallon drums. The container can be cycled and reused, adding only a new closure if the tamper-evident feature is desired or simply reused with the old plug body if tamper-evident requirements are not necessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper-evident buttress plug closure for use in closing the internally threaded and externally ratcheted outlet of a container comprises:

an externally threaded plug body threadedly engageable with the interior of said outlet and including means for advancing and withdrawing said plug body relative to said outlet;

a one-piece, continuous interlocking ring including a plurality of ratchet teeth engageable with said externally ratcheted outlet; and a connecting frangible element initially and integrally joining said interlocking ring to said plug body with said plug body received by said outlet and severable upon retrograde movement of said plug relative to said outlet.

2. The buttress plug closure of claim 1 wherein said interlocking ring includes a full circumferential series of ratchet teeth.

3. The buttress plug closure of claim 1 which further includes a total of four frangible elements initially and integrally joining said interlocking ring to said plug body, said four frangible elements being substantially equally spaced around the outer periphery of said plug body.

4. The buttress plug closure of claim 1 wherein said plug body includes a fluted recessed portion suitably designed and arranged for wrench-assisted removal of said plug and wrench-assisted insertion of said closure.

5. The buttress plug closure of claim 1 which further includes a synthetic seal disposed between said plug body and said container outlet.

6. The buttress plug closure of claim 1 wherein said interlocking ring includes a circumferential series of ratchet teeth and said closure further includes a total of four frangible elements initially and integrally connecting said interlocking ring to said plug body, said four frangible elements being substantially equally spaced from one another and said closure further includes a synthetic seal.

7. In combination:

a plastic container having a raised outlet, the outer surface of which is disposed with two series of ratchet teeth and the interior of which is internally threaded; and a tamper-evident buttress plug closure comprising:

an externally threaded plug body threadedly engageable with the interior of said outlet and including means for advancing and withdrawing said plug body relative to said outlet;

a one-piece, continuous interlocking ring including a plurality of ratchet teeth engageable with the exterior of said outlet; and a connecting frangible element initially and integrally joining said interlocking ring to said plug body with said plug body received by said outlet and severable upon retrograde movment of said plug relative to said outlet.

8. The combination of claim 7 wherein said interlocking ring includes a full circumferential series of ratchet teeth.

9. The combination of claim 7 which further includes a total of four frangible elements initially and integrally joining said interlocking ring to said plug body, said four frangible elements being substantially equally spaced around the outer periphery of said plug body.

10. The combination of claim 7 wherein said plug body includes a fluted recessed portion suitably designed and arranged for wrench-assisted removal of said plug and wrench-assisted insertion of said closure.

11. The combination of claim 7 which further includes a synthetic seal disposed between said plug body and said container outlet.

12. The combination of claim 7 wherein said interlocking ring includes a circumferential series of ratchet teeth and said closure further includes a total of four frangible elements initially and integrally connecting said interlocking ring to said plug body, said four frangible elements being substantially equally spaced from one another and said closure further includes a synthetic seal.

13. The combination of claim 7 which further includes raised portions disposed on the outer surface of said container outlet and positioned between said two series of ratchet teeth, said raised portions being suitably designed and arranged to preclude sufficient ovalizing of said interlocking ring in order to preclude disengagement of the engaging ratchet teeth.

14. A tamper-evident closure for use in closing an internally threaded container outlet, wherein the exterior surface of said container outlet includes outlet interlocking means disposed thereon, said closure comprising:

an externally threaded body portion integrally connected by at least one frangible element to a one-piece, continuous interlocking ring disposed radialy outward of and concentrically to said body portion and including closure interlocking means which are designed and arranged to be engageable with said outlet interlocking means upon threaded advancement of said body portion into said outlet and designed and arranged to prevent removal of said body portion from said outlet until said frangible element is severed.

15. The closure of claim 14 wherein said body portion further includes a fluted recess for wrench tightening of said body portion of said outlet.

16. The closure of claim 14 wherein said closure interlocking means includes a circumferentially continuous series of ratchet teeth.

17. In combination:

a plastic container having a raised outlet, the outer surface of which is disposed with two series of ratchet teeth and the interior of which is internally threaded; and a tamper-evident buttress plug closure comprising:

an externally threaded plug body threadedly engageable with the interior of said outlet and including means for advancing and withdrawing said plug body relative to said outlet;

a frangible interlocking ring including a plurality of ratchet teeth engageable with the exterior of said outlet;

a connecting frangible element initially and integrally joining said interlocking ring to said plug body with said plug body received by said outlet and severable upon retrograde movement of said plug relative to said outlet; and a plurality of raised portions disposed on the outer surface of said container outlet and positioned between said two series of ratchet teeth, said raised portions being suitably designed and arranged to preclude sufficient ovalizing of said interlocking ring in order to preclude disengagement of the engaging ratchet teeth.

18. In combination:

a molded plastic container having a raised outlet, the outer surface of which is disposed with two series of ratchet teeth and the interior of which is internally threaded, said raised outlet being disposed on opposite sides of a mold parting plant, and each of said two series of ratchet teeth being disposed on opposite sides of said parting plane wherein each tooth includes an incline ramp and straight wall portion wherein the plane of the straight wall portion of the end tooth in each series is substantially normal to said mold parting plane; and a tamper-evident buttress plug closure comrising:

an externally threaded plug body threadedly engageable with the interior of said outlet and including means for advancing and withdrawing said plug body relative to said outlet;

a frangible interlocking ring including a plurality of ratchet teeth engageable with the exterior of said outlet; and a connecting frangible element initially and integrally joining said interlocking ring to said plug body with said plug body received by said outlet and severable upon retrograde movement of said plug relative to said outlet.

19. A tamper-evident buttress plug closure for use in closing the internally threaded and externally ratcheted outlet of a container comprises:

an externally threaded plug body threadedly engageable with the interior of said outlet and including means for advancing and withdrawing said plug body relative to said outlet, said plug body including an upper surface;

a frangible interlocking ring including a plurality of ratchet teeth engageable with said externally ratcheted outlet, said interlocking ring having an upper surface and a depending side wall; and a connecting frangible element initially and integrally joining the upper surface of said interlocking ring to the upper surface of said plug body with said plug body received by said outlet and severable upon retrograde movement of said plug relative to said outlet.

* * * * *

UNITED STATES PATENT AND TRADEMARK OFFICE

CERTIFICATE OF CORRECTION

PATENT NO. : 4,785,963

DATED : November 22, 1988

INVENTOR(S) : Robert E. Magley

It is certified that error appears in the above-identified patent and that said Letters Patent are hereby corrected as shown below:

In column 10, line 46, please replace the word "plant" with the word —plane—.

Signed and Sealed this

Eighteenth Day of April, 1989

*Attest:*

DONALD J. QUIGG

*Attesting Officer*

*Commissioner of Patents and Trademarks*